US008672040B2

(12) United States Patent
Kobata et al.

(10) Patent No.: US 8,672,040 B2
(45) Date of Patent: Mar. 18, 2014

(54) MEASUREMENT OF RELATIVE TURNS AND DISPLACEMENT IN SUBSEA RUNNING TOOLS

(75) Inventors: Francisco Kazuo Kobata, Sao Paulo (BR); Lucas Antonio Perrucci, Sao Paulo (BR); Rafael Romeiro Aymone, Santana do Parnaiba (BR); Pedro Paulo Alfano, Santana do Parnaiba (BR); Saulo Labaki Agostinho, Sao Paulo (BR)

(73) Assignee: Vetco Gray Inc., Houston, TX (US)

( * ) Notice: Subject to any disclaimer, the term of this patent is extended or adjusted under 35 U.S.C. 154(b) by 146 days.

(21) Appl. No.: 13/282,643

(22) Filed: Oct. 27, 2011

(65) Prior Publication Data

US 2013/0105170 A1 May 2, 2013

(51) Int. Cl.
*E21B 23/00* (2006.01)

(52) U.S. Cl.
USPC ..... 166/360

(58) Field of Classification Search
USPC ..... 166/338, 339, 341, 348, 360, 368, 166/250.01, 255.1, 255.2, 378–381, 85.1; 340/853.1, 854.1; 702/6
See application file for complete search history.

(56) References Cited

U.S. PATENT DOCUMENTS

| | | | | |
|---|---|---|---|---|
| 4,715,451 | A | 12/1987 | Bseisu et al. | |
| 4,760,735 | A | 8/1988 | Sheppard et al. | |
| 4,862,426 | A * | 8/1989 | Cassity et al. | 367/81 |
| 5,347,859 | A | 9/1994 | Henneuse et al. | |
| 5,631,413 | A * | 5/1997 | Young et al. | 73/152.29 |
| 7,281,587 | B2 | 10/2007 | Haugen | |
| 7,591,304 | B2 | 9/2009 | Juhasz et al. | |
| 7,757,759 | B2 | 7/2010 | Jahn et al. | |
| 2002/0189806 | A1 * | 12/2002 | Davidson et al. | 166/250.01 |
| 2007/0039738 | A1 * | 2/2007 | Fenton et al. | 166/368 |
| 2008/0202810 | A1 | 8/2008 | Gomez | |

(Continued)

FOREIGN PATENT DOCUMENTS

| | | | |
|---|---|---|---|
| EP | 0320135 | A1 | 6/1989 |
| EP | 1793079 | A2 | 6/2007 |

(Continued)

OTHER PUBLICATIONS

GB Search Report dated Jan. 15, 2013 from corresponding Application No. GB1219178.9.

(Continued)

*Primary Examiner* — Matthew Buck
*Assistant Examiner* — Stacy Warren
(74) *Attorney, Agent, or Firm* — Bracewell & Giuliani LLP

(57) ABSTRACT

A running tool generates signals in response to setting of a subsea wellhead device that correspond to actual rotation and displacement of the running tool in the subsea wellhead. The running tool includes an encoder that generates a signal corresponding to the number of rotations of a stem of the running tool relative to a body of the running tool. The running tool also includes an axial displacement sensor that generates a signal corresponding to the axial displacement of a piston of the running tool relative to the body. The signals are communicated to the surface using an acoustic transmitter located on the running tool and an acoustic receptor located proximate to a drilling platform at the surface. The signals are communicated to an operator interface device from the receptor for further communication in a manner understood by an operator.

19 Claims, 13 Drawing Sheets

(56) References Cited

U.S. PATENT DOCUMENTS

| | | | | |
|---|---|---|---|---|
| 2010/0152901 | A1* | 6/2010 | Judge et al. | 700/275 |
| 2010/0252277 | A1* | 10/2010 | Gette | 166/382 |
| 2010/0314100 | A1 | 12/2010 | Tepavac et al. | |

FOREIGN PATENT DOCUMENTS

| | | | |
|---|---|---|---|
| GB | 2488659 | A | 9/2012 |
| WO | WO2005/065364 | A2 | 7/2005 |
| WO | WO2009/123462 | A1 | 10/2009 |

OTHER PUBLICATIONS

Francisco Kazuo Kobata et al., "Apparatus and Method for Measuring Weight and Torque at Downhole Locations while Landing, Setting, and Testing Subsea Wellhead Consumables," U.S. Appl. No. 13/040,002, filed Mar. 3, 2011.

* cited by examiner

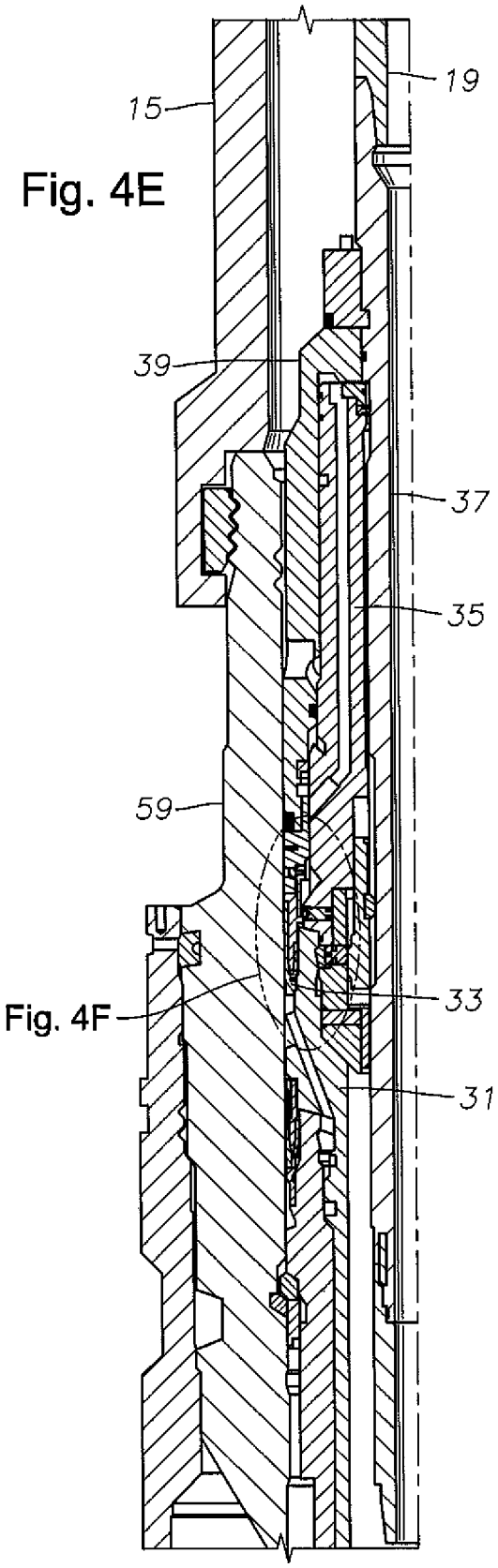
Fig. 4E
Fig. 4F
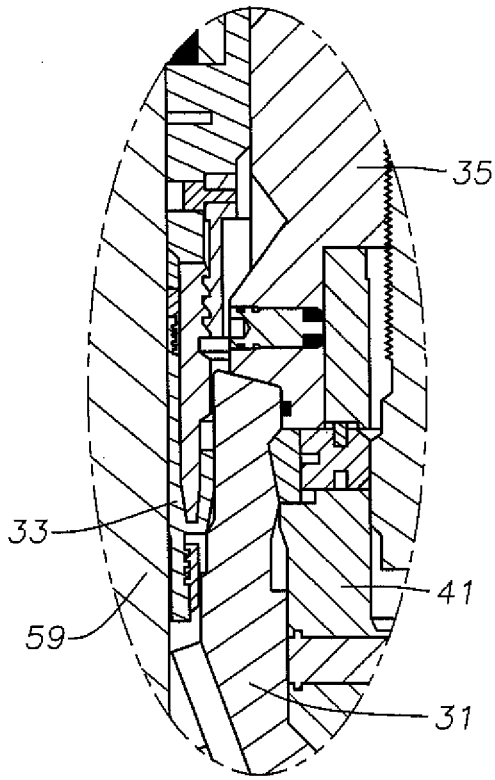

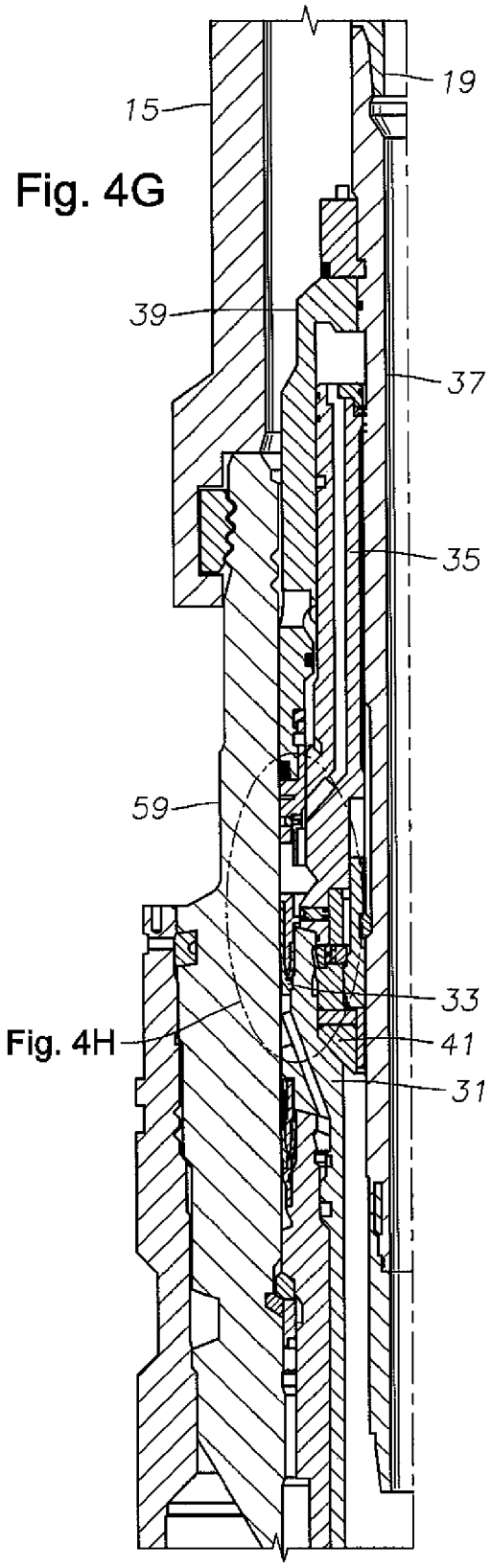
Fig. 4G
Fig. 4H
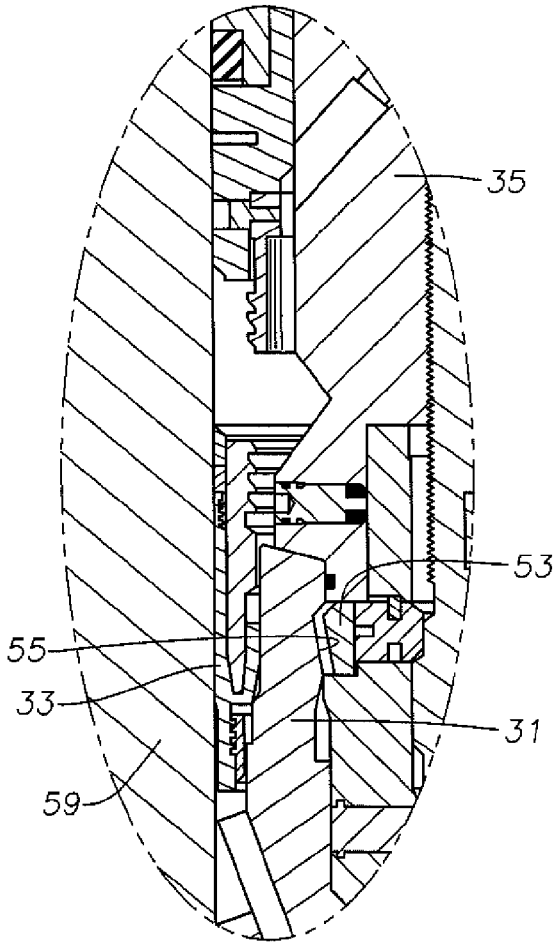

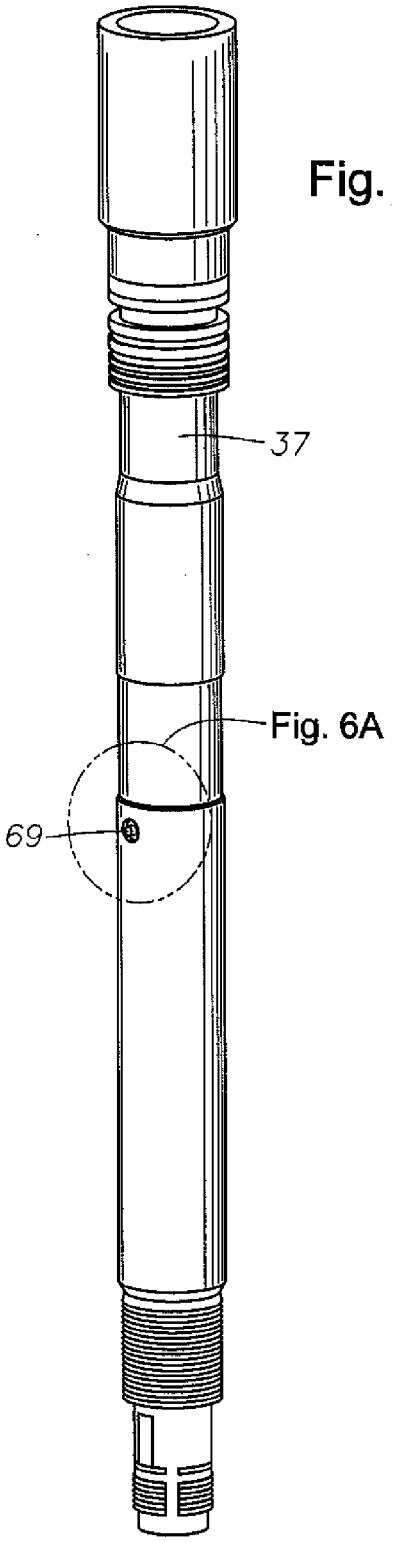
Fig. 6
Fig. 6A
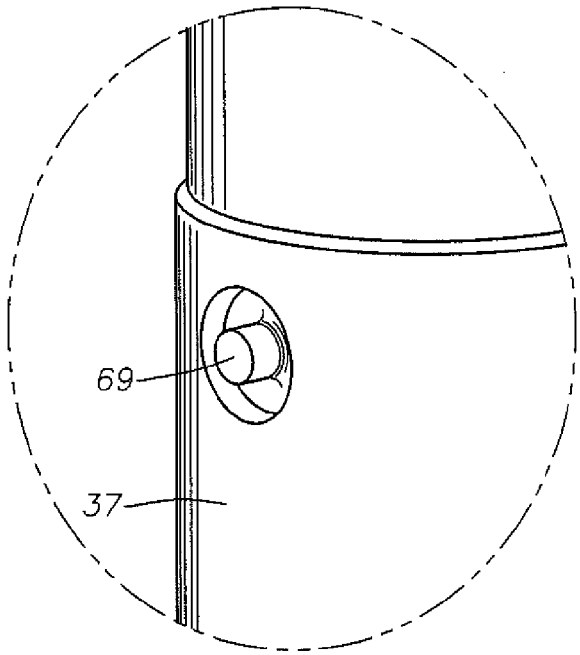

81
79
83
37
19
39
71
35
69
19
77

MEASUREMENT OF RELATIVE TURNS AND DISPLACEMENT IN SUBSEA RUNNING TOOLS

BACKGROUND OF THE INVENTION

1. Field of the Invention

This invention relates in general to subsea running tools and, in particular, to sensing the relative turns and relative displacement of a subsea running tool at mud line and sub mud line levels.

2. Brief Description of Related Art

In subsea operations, a surface platform generally floats over an area that is to be drilled. The surface platform then runs a drilling riser that extends from the surface platform to a wellhead located at the sea floor. The drilling riser serves as the lifeline between the vessel and the wellhead as most drilling operations are performed through the drilling riser. As devices are needed for the well, such as casing hangers, bridging hangers, seals, wear bushings, and the like, they pass from the surface of the vessel on a running string through the riser, through the wellhead and into the wellbore. Weight, rotation, and hydraulic pressure may be used to place and actuate these devices. Because of this, it is important to know with some specificity the relative number of turns and displacement of the running tool in the subsea environment. Knowing this information allows operators to know that the device has reached the appropriate position in the wellbore and properly actuated. Typically, this is accomplished by monitoring the number of running string turns and displacement of the running string at the surface platform.

Because surface platforms float over the subsea wellhead, they are subject to the effects of ocean currents and winds. Despite attempts to anchor the riser to the sea floor, ocean currents and winds will push surface platforms such that they do not remain completely stationary over the wellhead. In addition, the riser itself is subject to movement due to ocean currents. Because of this, the riser will not remain truly vertical between the wellhead and the surface platform. Instead, the riser will "curve" in response to the position of the vessel in relation to the wellhead and the effects of the current on the unanchored riser sections extending between the ends of the riser string anchored at the surface platform and at the wellhead. As locations in deeper water are explored, the problem becomes exacerbated.

As the riser curves, the running string passing through the riser will contact the riser rather than remaining coaxial within the riser. At the locations where the running string contacts the riser wall, the running string becomes anchored, and transmits some of the operational weight and torque, applied by the surface platform to the running string, from the running string to the riser. Thus, the actual torque and weight applied to the device in the wellbore is less than the total torque and weight applied at the surface platform. This difference within the relative number of turns and displacement of the running tool compared to the number of turns and running string displacement at the surface.

In addition, the difference in the number of turns and displacement applied at the surface and the number of turns and displacement at the running tool may be realized because of the length of the running string. The running string may extend thousands of feet through the riser between the wellhead and the surface. When turned, the segments of the running string may twist relative to one another, such that a portion of each turn is absorbed by the running string. Similarly, some axial displacement is absorbed by displacement of running string segments relative to one another. Thus, turns and displacement applied at the surface may not translate to an equal displacement or number of turns at the running tool at the wellhead. Therefore, there is a need for a method and apparatus for sensing number of turns and displacement of the running tool at a mud line and sub mud line level while landing, setting, and testing subsea wellhead devices with a running tool.

SUMMARY OF THE INVENTION

These and other problems are generally solved or circumvented, and technical advantages are generally achieved, by preferred embodiments of the present invention that provide an apparatus for measuring relative turns and relative displacement of a subsea running tool at downhole locations in real time, and a method for using the same.

In accordance with an embodiment of the present invention, a system for running and setting a subsea wellhead component is disclosed. The system includes a running tool having an upper end for coupling to a running string, the running tool adapted to carry and set the subsea wellhead component. The running tool has a body, a stem having an axis, the stem passing through the body, and a piston circumscribing the body. The stem is rotatable relative to the body, and the piston may move axially relative to the body to set the subsea wellhead component. An encoder is positioned between the stem and the body and to detect relative rotation between the stem and the body. An axial displacement sensor is positioned between the piston and the stem and to detect relative axial motion between the piston and the body. A transmitter is communicatively coupled to the encoder and the axial displacement sensor, and a receptor is communicatively coupled to the transmitter, the receptor located at a surface platform. An operator interface device is communicatively coupled to the receptor and located on the surface platform. The encoder and the axial displacement sensor communicate information regarding the relative number of turns and displacement, respectively, to the transmitter, the transmitter communicates the information to the receptor, and the receptor communicates the information to the operator interface device.

In accordance with another embodiment of the present invention, a system for running and setting a subsea wellhead component is disclosed. The system includes a running tool having an upper end for coupling to a running string, the running tool adapted to carry and set the component. The running tool has a body, a stem passing through the body, and a piston circumscribing the body. The body, the stem, and the piston are coaxial with an axis of the body, and the stem is rotatable relative to the body, and the piston may move axially relative to the body. An encoder is positioned between the stem and the body to detect relative rotation between the stem and the body and generate a rotation signal in response, and a transmitter is communicatively coupled to the encoder for transmitting the rotation signal to a surface platform. A receptor is located at the surface platform and communicatively coupled to the transmitter for receiving the rotation signal at the surface, and an operator interface device is communicatively coupled to the receptor. The operator interface device is located proximate to an operator of the drilling rig, so that the receptor may transmit the rotation signal to the operator interface device.

In accordance with yet another embodiment of the present invention, a system for running and setting a subsea wellhead component is disclosed. The system includes a running tool having an upper end for coupling to a running string, the running tool adapted to carry and set the component. The running tool has a body, a stem passing through the body, and a piston circumscribing the body, and the body, the stem, and the piston are coaxial with an axis of the body. The stem is rotatable relative to the body, and the piston may move axially relative to the body. An axial displacement sensor is positioned between the piston and the body to detect relative axial motion between the piston and the body and generate an axial signal in response. A transmitter is communicatively coupled to the axial displacement sensor for transmitting the axial signal to a surface. A receptor is located at the surface platform and communicatively coupled to the transmitter for receiving the axial signal at the surface, and an operator interface device is communicatively coupled to the receptor. The operator interface device is located proximate to an operator of the drilling rig, so that the receptor may transmit the axial signal to the operator interface for further communication of the signal.

In accordance with still another embodiment of the present invention, a method for running and setting a subsea wellhead device is disclosed. The method provides a running tool connected to the subsea wellhead device, the running tool having an encoder and axial displacement sensor coupled within a running tool for detecting running tool relative rotation and displacement. The method then runs the running tool from a surface platform to a subsea riser on a running string and positioning the subsea wellhead device in a subsea wellhead assembly. The method then operates the running tool to set the subsea device in the subsea wellhead assembly. While operating the running tool, the running tool generates a signal in the encoder and the axial displacement sensor in response to setting of the subsea device. The method then transmits the signal from the encoder and the axial displacement sensor to a display at the drilling rig; then presents the signal in a manner understood by an operator.

An advantage of a preferred embodiment is that it provides a measurement of the relative turns and displacement at a running tool location in the subsea wellbore in real time. This allows operators of a surface platform to have greater certainty that a subsea device to be set by the running tool has properly landed and set in the wellbore. In addition, by comparing the actual number of turns and displacement of the running tool to measurements of relative turns and displacement applied at the surface, operators will have an indication that the running string has anchored to the subsea riser.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

FIGS. 4A-4H are partial sectional and detail views illustrating operational steps in a process of landing and setting the casing hanger of FIG. 3 in a high pressure housing of the wellhead assembly of FIG. 2.

FIG. 6 is a schematic representation of a stem of the running tool of FIG. 3.

FIG. 6A is a detail view of the stem of FIG. 6 illustrating a light source installed thereon.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning drilling rig operation, riser make up and break out, operation and use of wellhead consumables, and the like have been omitted inasmuch as such details are not considered necessary to obtain a complete understanding of the present invention, and are considered to be within the skills of persons skilled in the relevant art.

Figure 1:
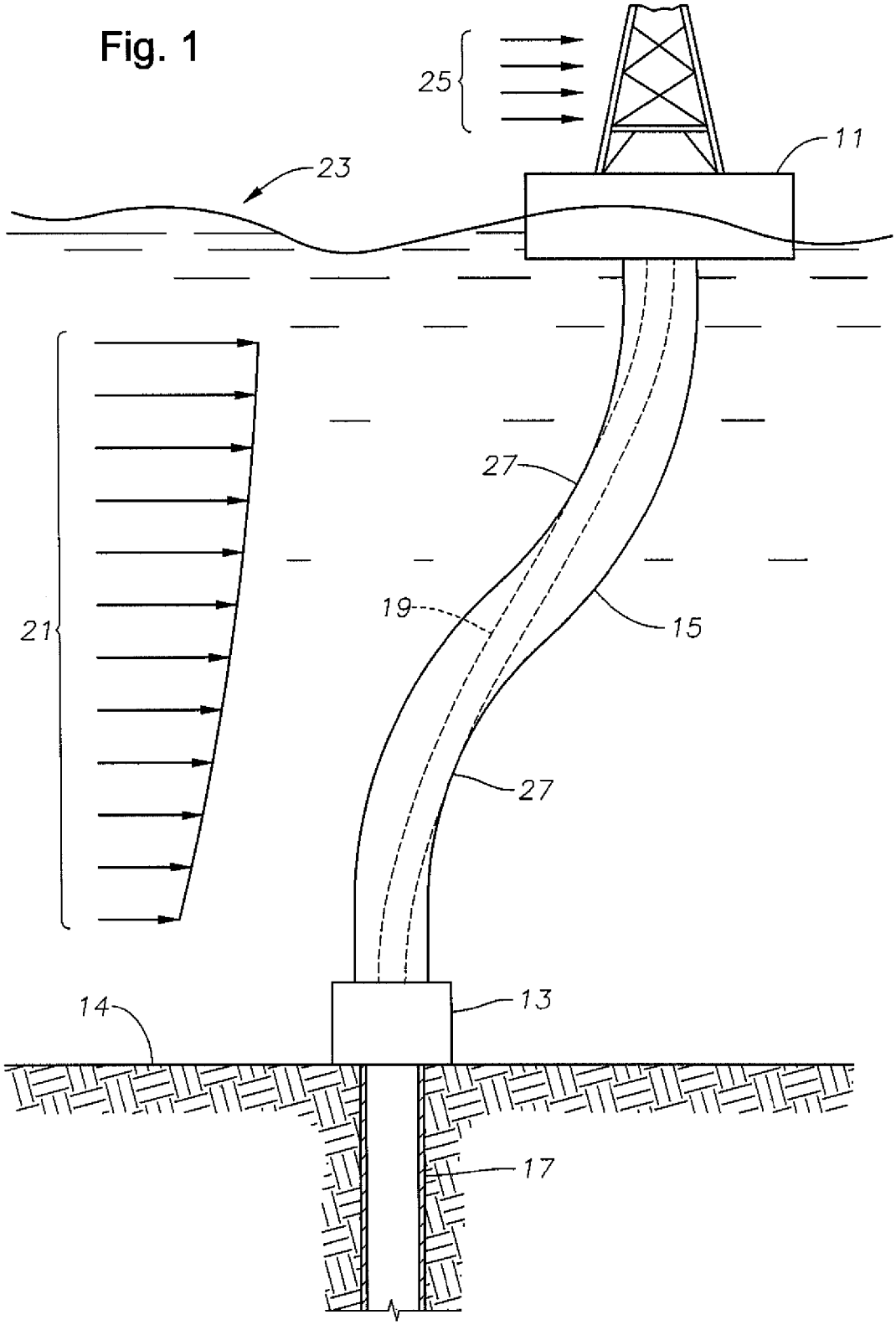
FIG. 1 is a schematic representation of a riser extending between a wellhead assembly and a floating platform.

Referring to FIG. 1, there is shown a floating drilling platform 11 connected to a wellhead assembly 13 at a subsea floor by a riser 15. A string 17, such as a casing string or liner string, extends from the wellhead assembly 13 to a subsurface wellbore bottom (not shown). Riser 15 enables drill pipe 19 to be deployed from floating platform 11 to wellhead assembly 13 and on into string 17 below a mud line 14. Running string 19 receives rotational torque and a downward force or weight from drilling devices located on floating platform 11. While made up of rigid members, riser 15 does not remain completely rigid as it traverses the distance between floating platform 11 and wellhead assembly 13. Riser 15 is comprised of joints each of which may allow some movement from substantially vertical. The combined effect of slight movement of each joint will cause riser 15 to "bend" in response to vertical motion from floating platform 11 due to surface swells 23, lateral motion caused by a subsea current 21, and lateral movement of floating platform 11 in response to a wind 25. As shown, subsea current 21, swells 23, and wind 25 have moved floating platform 11 so that riser 15 is in the curved position shown in FIG. 1.

Running string 19 does not "bend" in response to environmental conditions. Running string 19 remains substantially rigid as it passes through riser 15 from floating platform 11 to wellhead assembly 13, and then into string 17. Consequently, an exterior diameter of running string 19 may contact an inner diameter surface of riser 15 as shown at contact locations 27. At these locations, a portion of the rotational torque and weight applied to running string 19 at floating platform 11 transfers from running string 19 to riser 15, causing the actual applied torque and weight to downhole tools to be less than that applied at the surface. In addition, segments of running string 19 may twist relative to one another such that a portion of the rotation applied at drilling platform 11 may be absorbed by rotation of running string 19 segments relative to one another.

Figure 2:
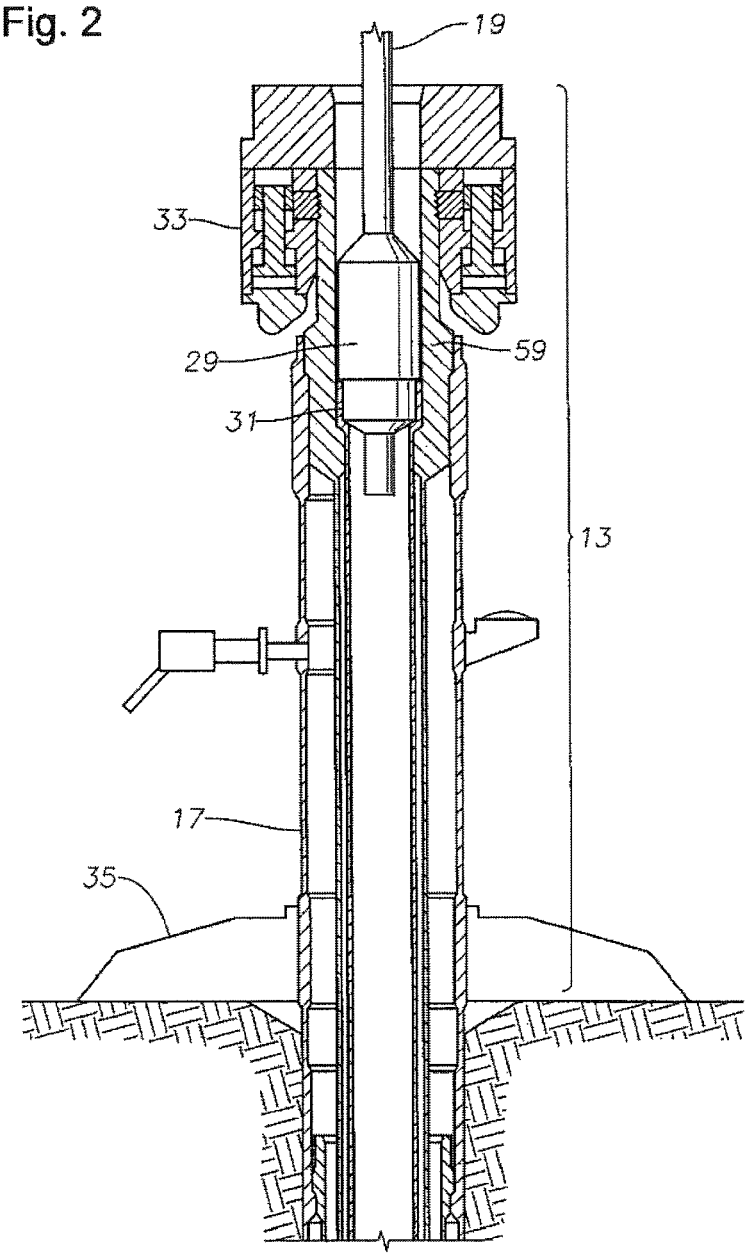
FIG. 2 is a schematic sectional representation of a subsea wellhead assembly with a running tool disposed therein.

As shown in FIG. 2, a running tool 29 is suspended on running string 19 within a high pressure housing 59 to set a subsea wellhead device, such as casing hanger 31. Running tool 29 is a subsea tool used to land and operate subsea wellhead equipment such as casing hangers, tubing hangers, seals, wellhead housings, trees, etc. For example, running tool 29 may be a pressure assisted drill pipe running tool (PADPRT), as described in more detail below. Running tool 29 is run on running string 19 to a position within wellhead assembly 13 such as at a blow out preventer (BOP) 33, or further down string 17, such as at wellhead 35 or even further downhole.

Figure 3:
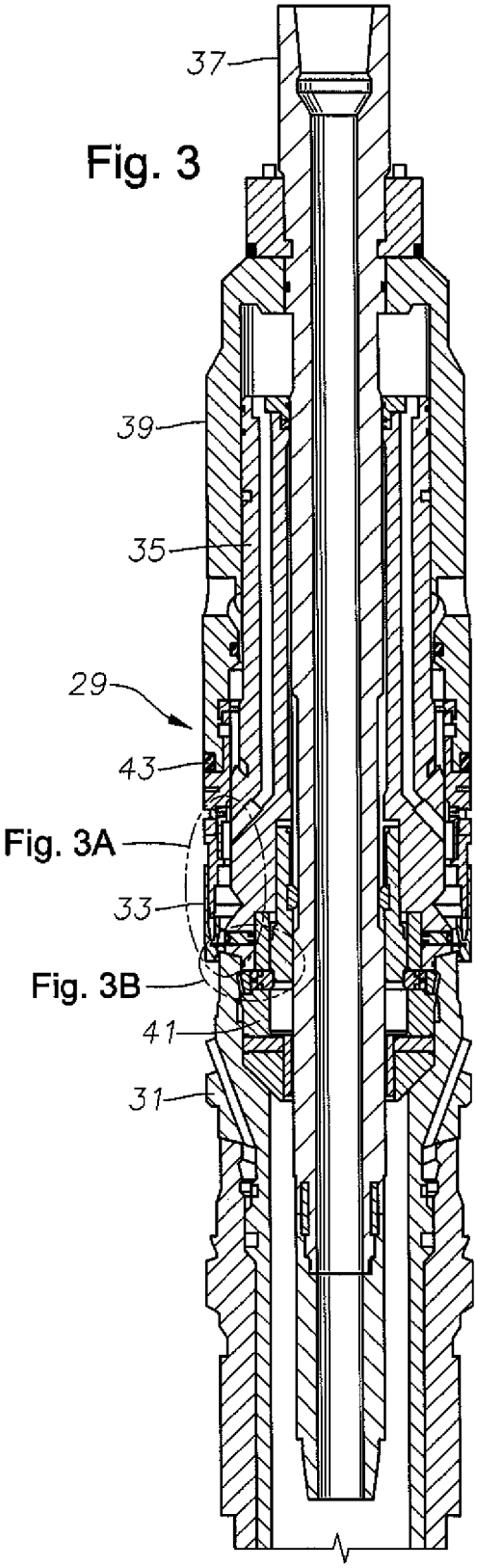
FIG. 3 is a sectional schematic representation of the running tool of FIG. 2 connected to a casing hanger and casing hanger seal.
Figure 3A:
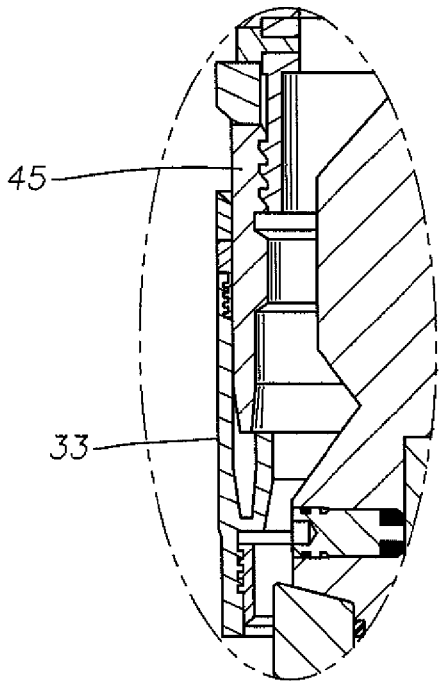
FIG. 3A is a detail view of the connection between the casing hanger seal and the running tool.
Figure 3B:
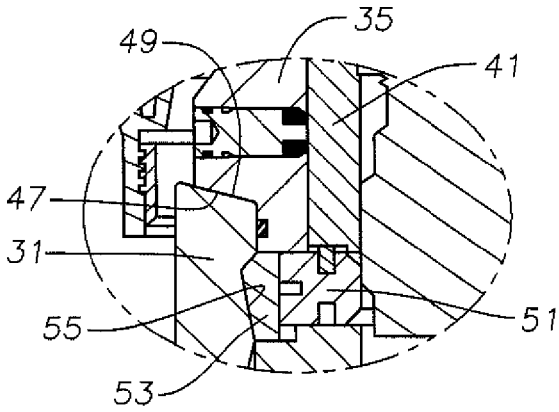
FIG. 3B is a detail view of the connection between the casing hanger and the running tool.

Referring to FIG. 3, running tool 29 is shown coupled to casing hanger 31 and a casing hanger seal 33. The process of coupling casing hanger 31 to running tool 29 may be completed at the surface in the manner described herein. Running tool 29 includes a body 35, a stem 37, a piston 39, a bearing cap 41, and a running tool seal 43. Casing hanger seal 33 is connected to running tool 29 through a tool and seal lock system 45, as shown in FIG. 3A. Tool and seal lock system 45 may secure casing hanger seal 33 to running tool 29 through an interference fit between corresponding annular protrusions on the inner and outer diameters of casing hanger seal 33 and running tool 29, respectively. A lower portion of running tool 29 may be run into casing hanger 31 so that a downward facing shoulder 47 of body 35 contacts an upward facing shoulder 49 of casing hanger 31 as shown in FIG. 3B. Stem 37 may then be rotated four turns in a first direction to energize a running tool anchor system 51 and engage a running tool locking dog 53 with a profile 55 formed on an inner diameter of casing hanger 31 as shown in FIG. 3B. Running tool 29 and casing hanger 31 may then be run through riser 15 to a location in wellhead assembly 13 as shown in FIG. 2.

Figure 4A:
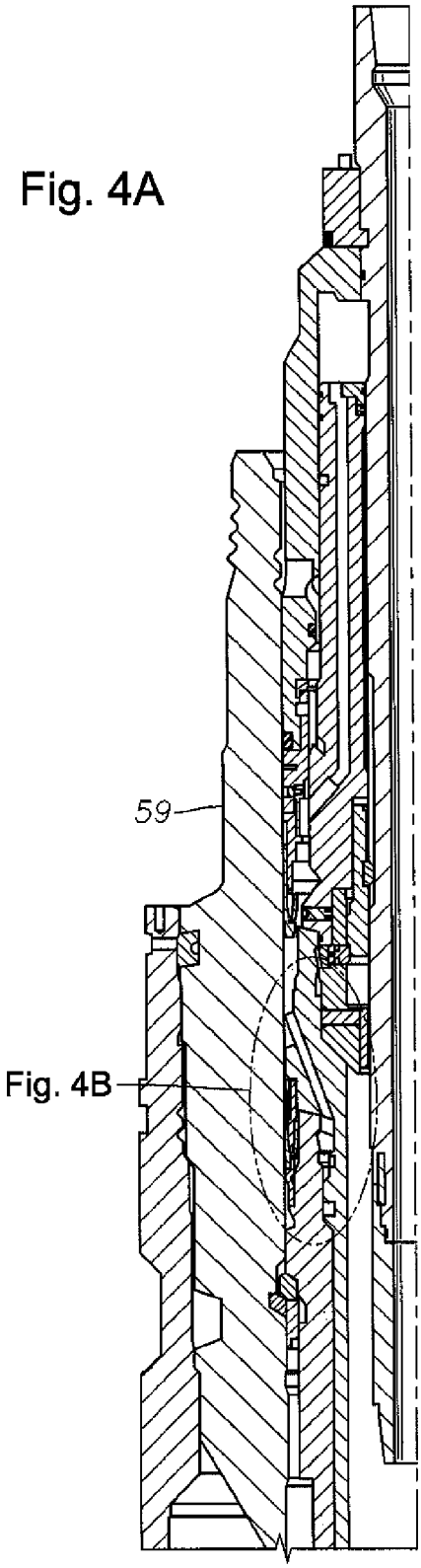
Figure 4B:
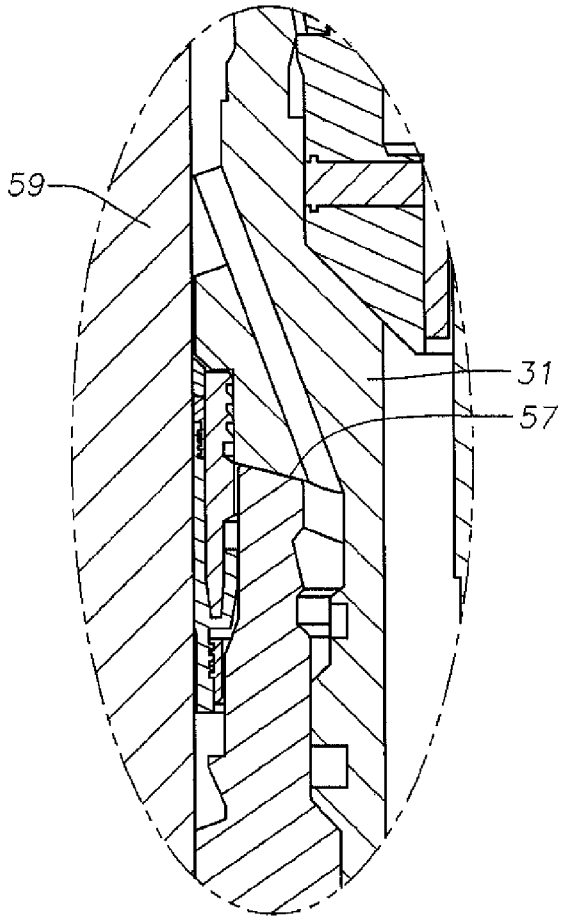
Figure 4C:
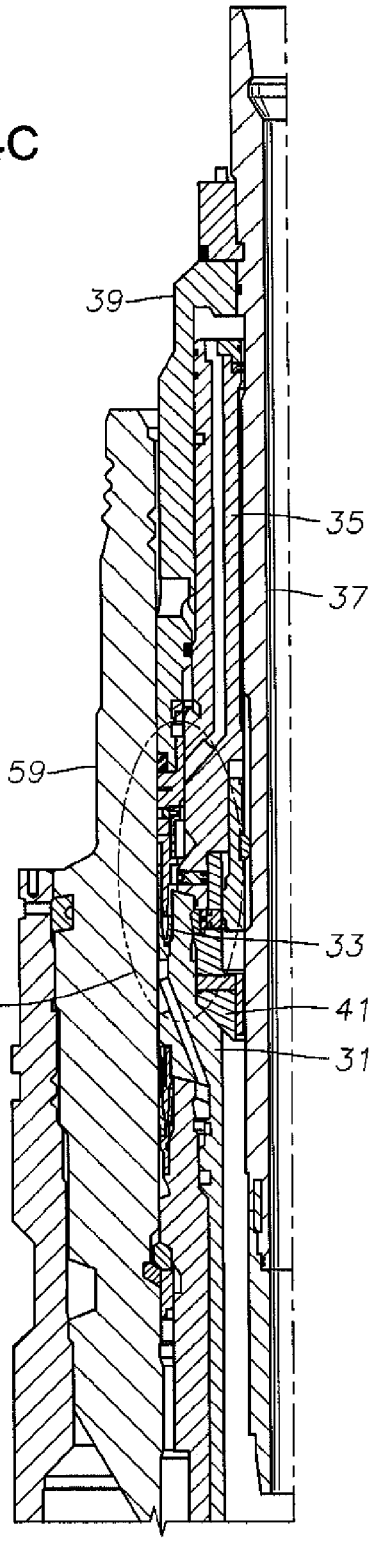
Figure 4D:
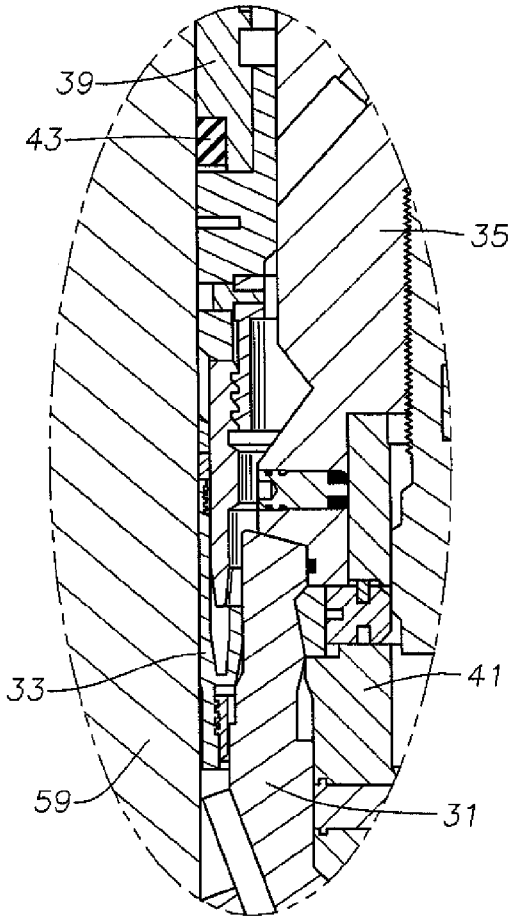

As shown in FIG. 4A, running tool 29 and casing hanger 31 may land on a load shoulder 57 within high pressure housing 59. Load shoulder 57 may be an upper rim of a prior run casing hanger as shown in FIG. 4B, or an upward facing shoulder formed in an inner diameter of high pressure housing 59. Once landed, stem 37 may be rotated in the first direction an additional four turns to release stem 37 from body 35 and bearing cap 41 as shown in FIG. 4C. Axial movement of stem 37 will result in corresponding axial movement of piston 39 and casing hanger seal 33 coupled thereto. As shown in FIG. 4D, stem 37, piston 39 and casing hanger seal 33 may move axially downward until casing hanger seal 33 is interposed between high pressure housing 59 and casing hanger 31. Running tool seal 43 may be energized to an inner diameter of high pressure housing 59 during this process. Fluid pressure may be applied to the annulus between riser 15 and running string 19 as shown in FIG. 4E to move piston 39 further downward axially and energize casing hanger seal 33 as shown in FIG. 4F. Stem 37 and piston 39 may then be pulled axially upward as shown in FIG. 4G. Four additional turns of stem 37 may be applied through running string 19 to de-energize running tool anchor system 51 and disengage running tool locking dog 53 from profile 55 of casing hanger 31 as shown in FIG. 4H. This completes the landing and setting process of casing hanger 31. To determine if casing hanger 31 was properly landed and set within high pressure housing 59, knowledge of the true number of turns and axial displacement of the components of running tool 29 during the previously described process is necessary.

Figure 5A:
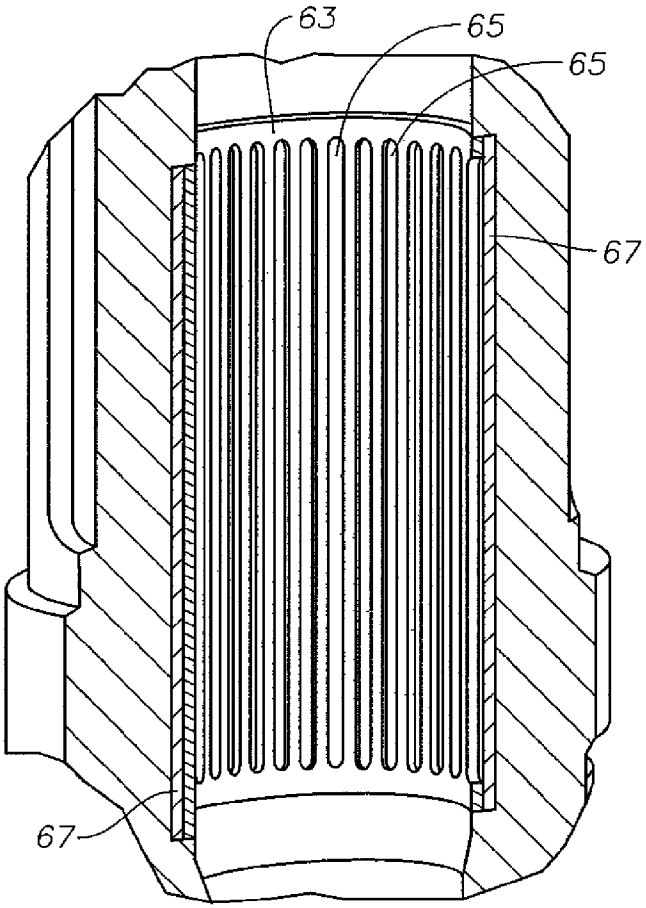
FIG. 5A is a detail view of the code cylinder and body of FIG. 5.
Figure 5:
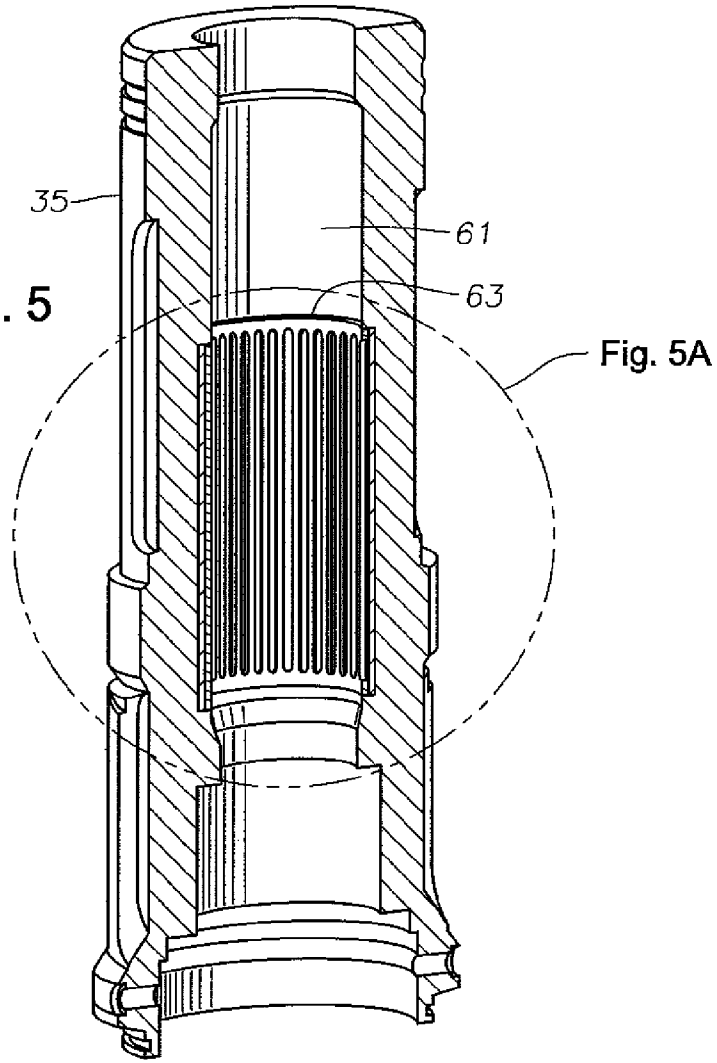
FIG. 5 is a sectional view of a body of the running tool of FIG. 3 with a code cylinder installed thereon.

Referring to FIG. 5, body 35 of running tool 29 will define a central bore 61 through which stem 37 (not shown) may pass. A code cylinder 63 may be secured to an inner diameter of body 37 within central bore 61. Referring to FIG. 5A, code cylinder 63 is a tubular body having an outer diameter substantially equivalent to the inner diameter of central bore 61. Code cylinder 63 defines a plurality of windows 65 around the circumference of code cylinder 63. Each window 65 extends from an inner diameter of code cylinder 63 to an outer diameter of code cylinder 63. The spacing of windows 65 around code cylinder 63 may correspond to a specific rotational position around the circumference of body 35. Each window 65 may extend the length of code cylinder 63. Code cylinder 63 may be formed of any suitable material, such as glass or plastic, for use as described herein.

One or more photodiode sensors 67 may be placed relative to code cylinder 63 and the inner diameter of body 35. In an embodiment, a single photodiode sensor 67 is interposed between code cylinder 63 and the inner diameter of central bore 61. The single photodiode sensor 67 may only be exposed to central bore 61 through a single window 65. In another embodiment, a plurality of individual photodiode sensors 67 are interposed between code cylinder 63 and the inner diameter of central bore 61. The plurality of individual photodiode sensors 67 may each be exposed to central bore 61 through a corresponding separate window 65. In still another embodiment, a single tubular photodiode sensor 67 is interposed between code cylinder 63 and the inner diameter of central bore 61. The photodiode sensor 67 will be exposed to central bore 61 through each window 65.

Referring to FIGS. 6 and 6A, stem 37 may include a light source 69 set within a bore extending radially inward from an outer diameter of stem 37. Light source 69 may be any suitable light source, microwave, infrared, visible, ultraviolet, etc., such that photodiode sensors 67 may generate an electrical signal when exposed to the light from light source 69. Light source 69 will be positioned so that light from light source 69 will be directed radially outward when stem 37 is inserted through body 35. In the illustrated embodiment, light source 69 may be near an axial center of code cylinder 63 (FIG. 5) when stem 37 is inserted into central bore 63 of body 35. In an embodiment, when stem 37 moves axially through body 35, light source 69 will not move beyond the axial height of code cylinder 63. Additional axial range may be provided by extending the axial height of code cylinder 63 and photodiode 67. Light source 69 may be powered by a battery internal to light source 69. In other embodiments, light source 69 may be powered by an external power source. In the illustrated embodiment, code cylinder 63, photodiode sensors 67, and light source 69 may be referred to collectively as an encoder.

In an embodiment, stem 37 may rotate relative to body 35 as described above with respect to FIGS. 4A-4H. During rotation of stem 37, light source 69 may direct light radially outward from stem 37. A person skilled in the art will understand that light source 69 may be powered on a surface platform 25, or alternatively switched on prior to operation of running tool 29. In an embodiment having a single photodiode sensor 67 exposed through a single window 65, as stem 37 rotates, light source 69 will expose photodiode sensor 67 once per full revolution of stem 37 relative to body 35. At each exposure of photodiode sensor 67, photodiode sensor 67 will generate an electrical signal. This electrical signal may indicate that a revolution of stem 37 relative to body 35 has been completed. Photodiode sensor 67 may be coupled to a controller, or further coupled to an operator interface, described in more detail below, that can record the number of revolutions of stem 37 or otherwise indicate the relative number of turns of stem 37 to body 35.

In an embodiment having a plurality of photodiode sensors 67, each exposed through a separate corresponding window 65, light source 69 will expose each separate photodiode sensor 67 once per revolution of stem 37 relative to body 35. At each exposure of each separate photodiode sensor 67, photodiode sensor 67 will generate an electrical signal. Each photodiode sensor 67 will be correlated to a position on body 35. Photodiode sensor 67 may be coupled to a controller, or further coupled to an operator interface, described in more detail below, that can register the particular photodiode sensor 67 generating the electrical signal. Thus, a rotational position of stem 37 relative to body 35 may be detected and recorded or otherwise presented in addition to the relative number of rotations of stem 37 to body 35. This correlation may be transmitted to the surface to provide an operator with the rotational position of stem 37 or the number of turns of stem 37 as described in more detail below.

In an embodiment having a single photodiode sensor 67 extending the circumference of bore 61 of body 35, photodiode sensor 67 exposed through each window 65, light source 69 will expose photodiode sensor 67 multiple times during each revolution of stem 37 relative to body 35. Photodiode sensor 67 may be communicatively coupled to a controller or operator interface device that will register the relative number of signals generated from initiation of stem 37 rotation relative to body 35. This register of signals may be correlated to a number of rotations of stem 37 relative to body 35 and to a relative rotational position of stem 37 to body 35 based on the total number of signals generated since rotation initiation. For example, if there are six windows 65 exposing the single photodiode sensor 67, six signals will be generated per every revolution of stem 37 relative to body 35. The operator interface device may count each signal and indicate at every signal the total number or rotations of stem 37 relative to body 35 beginning with the initial rotation of stem 37. For example, while securing casing hanger 33 to running tool 29, stem 37 will rotate four times relative to body 37. The operator interface device may receive 21 signals beginning with the initial rotation of stem 37. The operator interface device may then indicate that a total of 3.5 revolutions of stem 37 relative to body 35 have occurred. In this manner, an operator may understand that an additional half or a revolution of stem 37 relative to body 35 is needed. This information may be communicated to the surface as described below with respect to FIG. 10.

Figure 7:
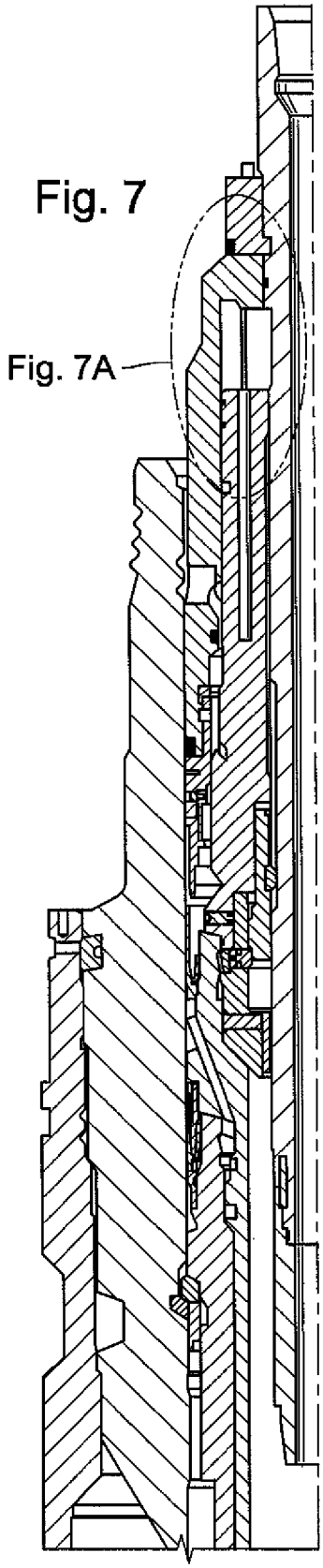
FIG. 7 is a partial sectional schematic representation of the running tool of FIG. 3 with an axial displacement sensor installed thereon.
Figure 7A:
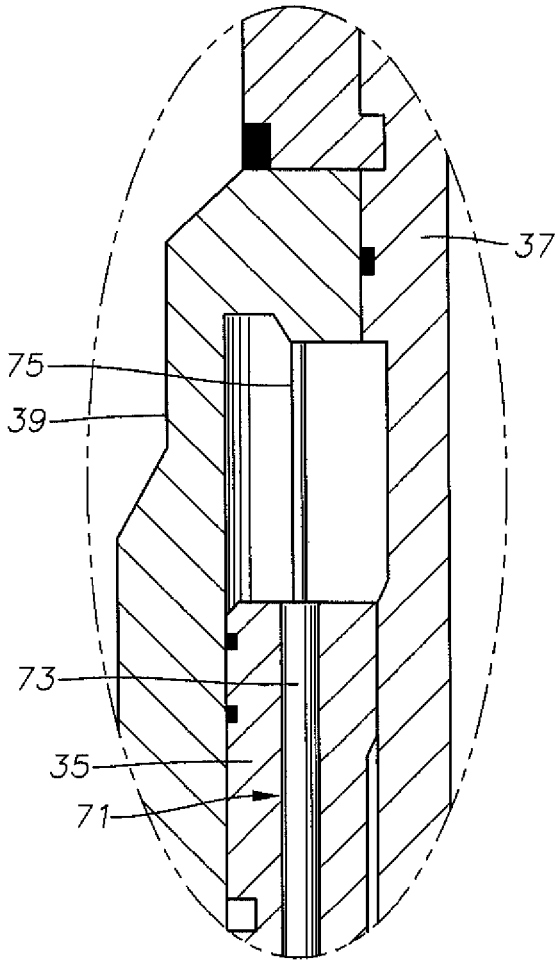
FIG. 7A is a detail view of the installation of the axial displacement sensor of FIG. 7.

Referring to FIG. 7, an axial displacement sensor, in the illustrated embodiment a linear variable differential transformer (LVDT) 71, in a tubular wall of body 35 is shown. The axial displacement sensor may be any suitable device capable of detecting axial displacement between body 35 and piston 39. In the illustrated embodiment, LVDT 71 will include a tube 73 containing solenoidal coils placed end-to-end around tube 73. In an embodiment, three solenoidal coils are used, a center coil being a primary coil and a secondary coil on either side of the primary coil. A cylindrical ferromagnetic core 75 is positioned within tube 73 so that core 75 may pass through the three solenoidal coils. An alternating current may be applied to the primary core of tube 73 from a power source, such as a battery that may be located within running tool 29, electric power supplied to the running tool through an electric umbilical, or the like. The alternating current will induce a voltage in each of the two secondaries. As core 75 moves axially through tube 73, core 75 will cause a change in the voltage induced in each secondary. LVDT 71 produces an output voltage that corresponds to the difference in the voltages induced in the two secondaries. When core 75 is in a neutral position the output voltage will be approximately zero. Thus, when core 75 moves through tube 73, one or the other secondary will induce a greater voltage causing a change in the output voltage. The magnitude of the output voltage of LVDT 71 will correspond to the amount core 75 is displaced. Core 75 will have an outer end moveable in response to axial motion of piston 39. In an embodiment, the outer end of core 75 may interact with a downward facing shoulder of piston 39. In an alternative embodiment, the outer end of core 75 is attached to a tubular wall portion of piston 39. As piston 39 moves axially downward during the landing and setting process, core 75 will pass through the coils of tube 73 causing a voltage output that may be correlated with the axial position of piston 39 relative to body 35. This correlation may be transmitted to the surface to provide an operator with the displacement of piston 39 as described in more detail below.

Figure 8:
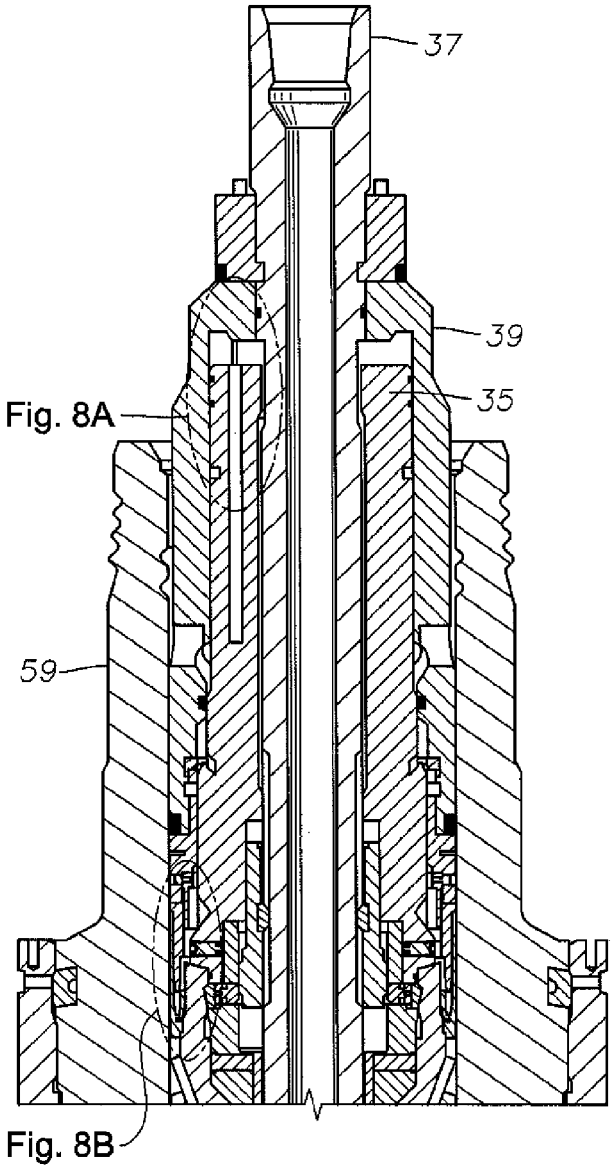
FIGS. 8, 8A, and 8B are sectional schematic and detail representations of the setting of the casing hanger seal of FIG. 3.
Figure 8A:
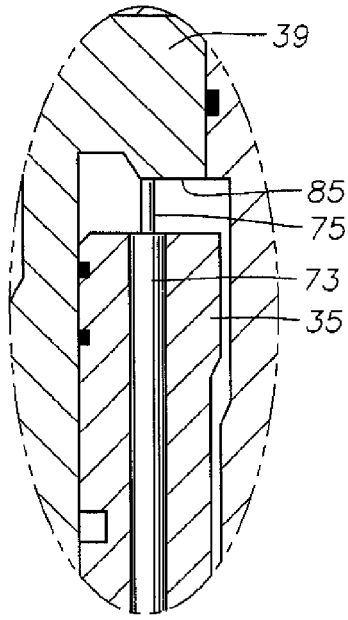
Figure 8B:
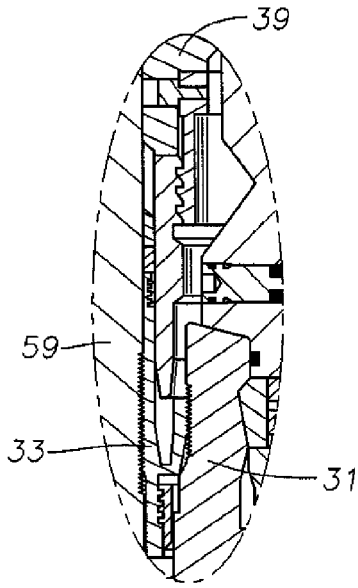
Figure 9:
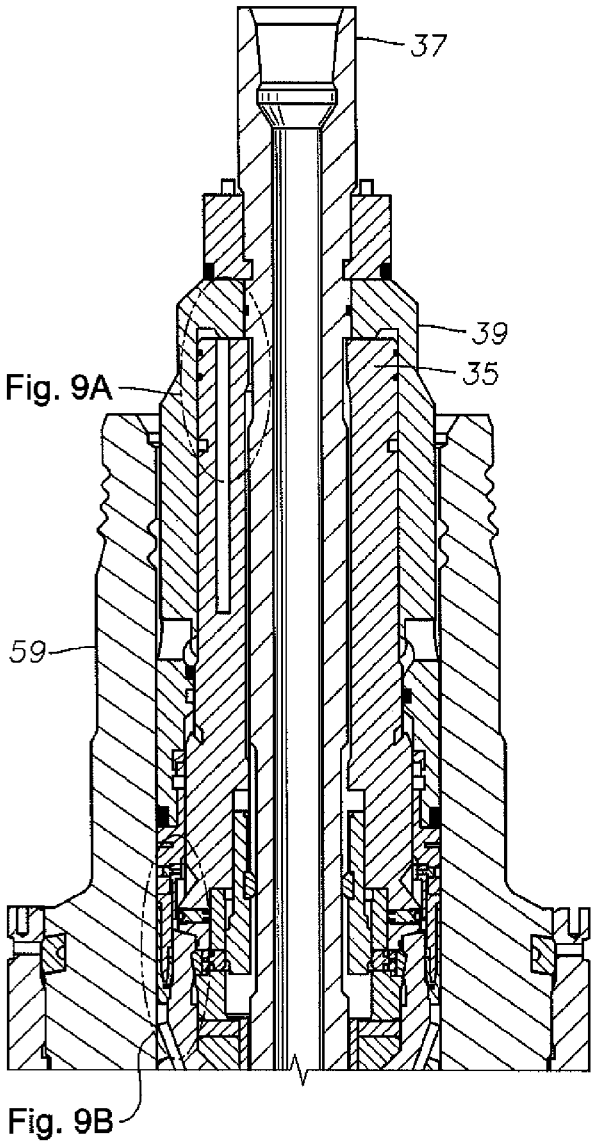
FIGS. 9, 9A, and 9B are sectional schematic and detail representations of the setting of the casing hanger seal of FIG. 3.
Figure 9A:
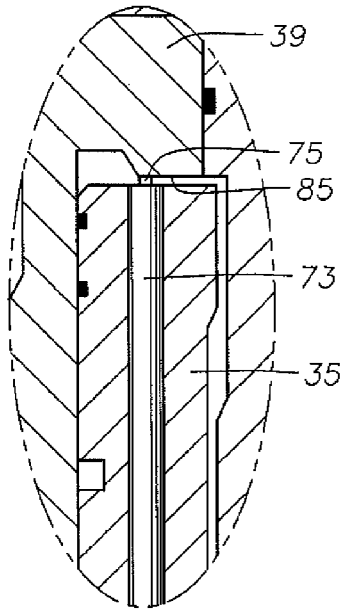
Figure 9B:
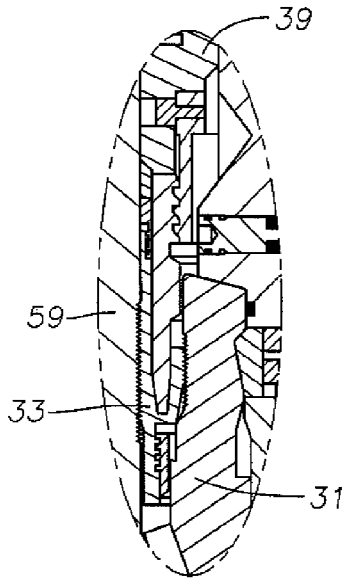

Referring to FIGS. 8 and 9, as piston 39 moves axially downward during setting of casing hanger seal 33, as described above with respect to FIGS. 4A-4H, core 75 will move axially downward through tube 73, generating an output voltage in response. For example, as shown in FIG. 8B, piston 39 is in contact with an energizing ring of casing hanger seal 33. As piston 39 moves axially downward, piston 39 causes the energizing ring of casing hanger seal 33 to energize casing hanger seal 33 by engaging wickers on an inner diameter of high pressure housing 59 and an outer diameter of casing hanger 31, as shown in FIG. 9B. As shown in FIG. 8A, the downward movement of piston 39 may cause a downward facing shoulder 85 of piston 39 to engage an end of core 75 of LVDT 71. As piston 39 moves axially downward relative to body 35 to set casing hanger seal 31, downward facing shoulder 85 will move core 75 through tube 73 until downward facing shoulder 85 is proximate to an upper rim of body 35. This will cause the output voltage of LVDT 71 to change in proportion to the amount of core 75 movement through tube 73. This output voltage may be communicated to the surface as described in more detail below.

Figure 10:
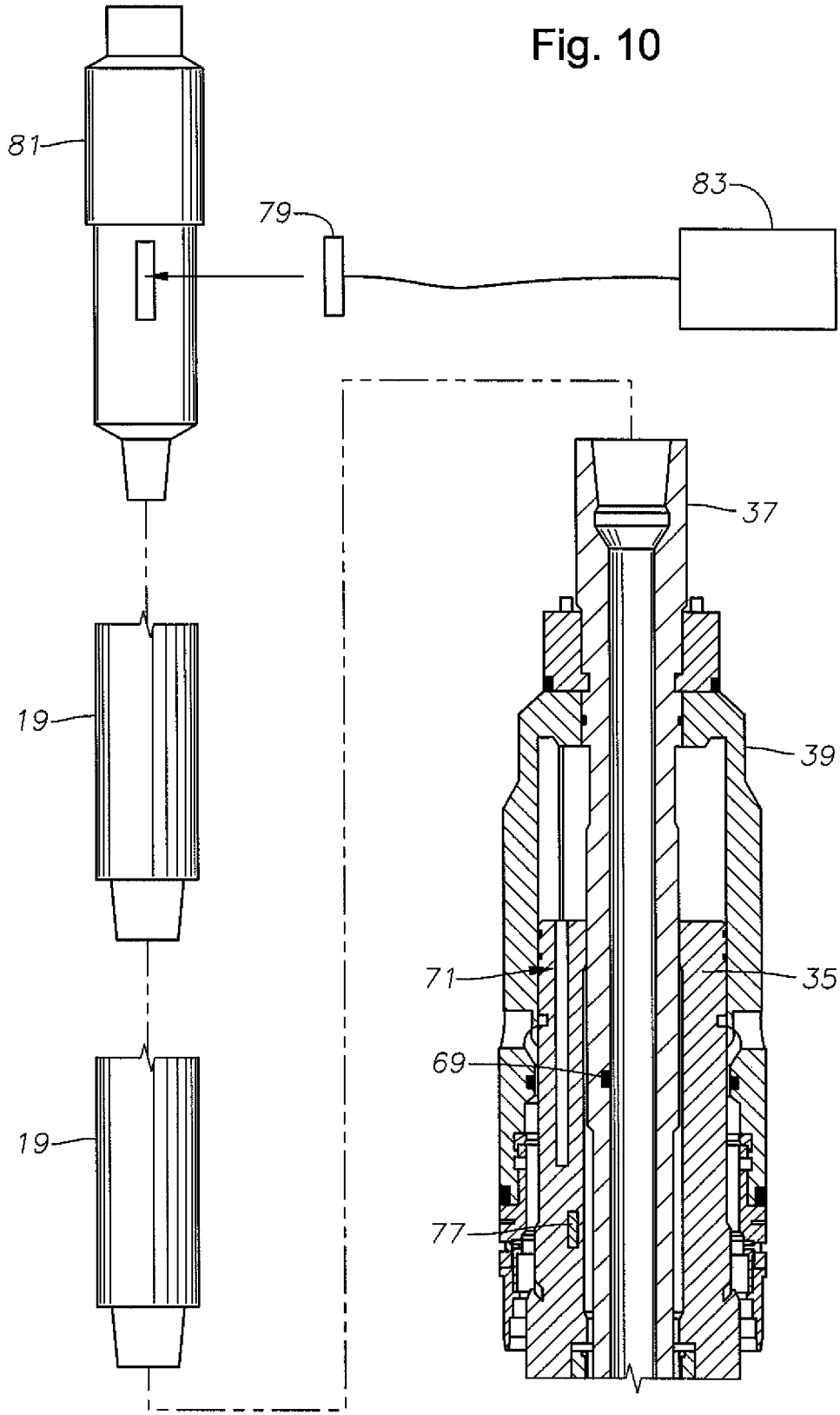
FIG. 10 is a schematic representation of a communication system between the running tool of FIG. 3 and the surface platform of FIG. 1.

Referring to FIG. 10, photodiode sensors 67 and LVDT 71 may both be communicatively coupled to a transmitter 77. Transmitter 77 may be positioned within a tubular wall of body 35. Transmitter 77 may be any suitable data transmission device for use in a subsurface environment. For example transmitter 77 may be an acoustic transmitter capable of receiving electrical input from photodiode sensors 67 and LVDT 71 and converting the electrical signals into acoustic signals that may be passed through running string 19 or drilling mud circulated through running string 19. The acoustic signals generated by transmitter 77 may be received by a receptor 79 positioned within a receptor stem 81 coupled to running string 19 at platform 11. Receptor 79 may receive the acoustic signals and convert them back into electrical or digital signals. Receptor 79 may be communicatively coupled to an operator interface device 83 located at platform 11 where the signals are converted into a medium understandable to an operator located proximate to operator interface device 83. The operator interface device 83 may be any suitable mechanism to communicate the signals from the encoder and LVDT 71 to an operator located at platform 11. In an embodiment, operator interface device 83 is a display. In another embodiment, operator interface device 83 is a computing device, such as a computer workstation, tablet, controller, or the like, that may display information received from receptor 79 or communicate that information to an operator in any suitable manner. There the operator may interpret the signals and adjust operations to add additional rotations at the surface or additional set down weight or hydraulic pressure to complete setting of casing hanger 31.

Accordingly, the disclosed embodiments provide numerous advantages. For example, it provides a measurement of the relative turns and displacement at a running tool location in the subsea wellbore in real time. This allows operators of a surface platform to have greater certainty that a subsea device to be set by the running tool has properly landed and set in the wellbore. In addition, by comparing the actual number of turns and displacement of the running tool to measurements of relative turns and displacement applied at the surface, operators will have an indication that the running string has anchored to the subsea riser.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A system for running and setting a subsea wellhead component, comprising:

a running tool having an upper end for coupling to a running string, the running tool adapted to carry and set the subsea wellhead component;

wherein the running tool has a body, a stem having an axis, the stem passing through the body, and a piston circumscribing the body; and wherein the stem is rotatable relative to the body, and the piston may move axially relative to the body to set the subsea wellhead component;

an encoder positioned between the stem and the body to detect relative rotation between the stem and the body, the encoder comprising:

a light source positioned on the stem so that the light source may direct a light radially outward;

a code cylinder positioned on an inner diameter of the body so that the code cylinder may be exposed to the light produced by the light source, the code cylinder defining a plurality of windows that are elongated in an axial direction, the windows permitting light from the light source to pass through the code cylinder; and a photodiode placed radially outward of the code cylinder such that the photodiode is operable to detect light from the light source passing through the plurality of windows;

an axial displacement sensor positioned between the piston and the body to detect relative axial motion between the piston and the body;

a transmitter communicatively coupled to the encoder and the axial displacement sensor;

a receptor communicatively coupled to the transmitter, the receptor adapted to be located at a surface platform;

an operator interface device communicatively coupled to the receptor and adapted to be located on the surface platform; and wherein the encoder and the axial displacement sensor communicate information regarding the relative number of turns and displacement, respectively, to the transmitter, the transmitter communicates the information to the receptor, and the receptor communicates the information to the operator interface device.

2. The system of claim 1, wherein the axial displacement sensor comprises:

a tube positioned within the body, the tube having at least one solenoidal coil; and a ferromagnetic core positioned partially within the tube so that movement of the core through the tube produces an electrical output;

wherein an end of the core interacts with the piston to move in response to axial displacement of the piston; and wherein axial movement of the piston relative to the body to energize a casing hanger seal releasably secured to the running tool will move the core through the tube, generating an output signal conveying the amount of axial displacement of the piston relative to the body.

3. The system of claim 1, wherein:

the photodiode is placed between the code cylinder and the body; and the photodiode is alternatingly exposed to and blocked from the light source during rotation of the stem relative to the body.

4. The system of claim 1, wherein the encoder registers a number of rotations of the stem relative to the body.

5. The system of claim 1, wherein the transmitter is an acoustic transmitter and the receptor is an acoustic receptor.

6. A system for running and setting a subsea wellhead component, comprising:

a running tool having an upper end for coupling to a running string, the running tool adapted to carry and set the component;

wherein the running tool has a body, a stem passing through the body, and a piston circumscribing the body;

wherein the body, the stem, and the piston are coaxial with an axis of the body;

wherein the stem is rotatable relative to the body, and the piston may move axially relative to the body;

an encoder positioned between the stem and the body to detect relative rotation between the stem and the body and generate a rotation signal in response, the encoder comprising:

a light source positioned to direct light in a radial direction;

a light sensor radially spaced from the light source and operable to detect a light from the light source; and a code cylinder positioned radially between the light source and the light sensor, the code cylinder defining a plurality of windows that are elongated in an axial direction, the windows permitting light from the light source to pass through the code cylinder;

a transmitter communicatively coupled to the encoder for transmitting the rotation signal to a surface platform;

a receptor adapted to be located at the surface platform and communicatively coupled to the transmitter for receiving the rotation signal at the surface;

an operator interface device communicatively coupled to the receptor; and wherein the operator interface device is adapted to be located proximate to an operator of the drilling rig, so that the receptor may transmit the rotation signal to the operator interface device.

7. The system of claim 6, further comprising:

an axial displacement sensor adapted to detect relative axial motion between the piston and the body and generate an axial signal in response; and the axial displacement sensor communicatively coupled to the transmitter for transmitting the axial signal to the operator interface device through the receptor.

8. The system of claim 6, wherein the light source is positioned on the stem so that the light source may direct the light radially outward; and wherein the code cylinder is positioned on an inner diameter surface of the body so that the code cylinder may be exposed to the light produced by the light source.

9. The system of claim 8, wherein the light sensor is a photodiode placed on the inner diameter surface of the body; and the photodiode is alternatingly exposed to and blocked from the light source through the plurality of windows of the code cylinder during rotation of the stem relative to the body.

10. A system for running and setting a subsea wellhead component, comprising:

a running tool having an upper end for coupling to a running string, the running tool adapted to carry and set the component;

wherein the running tool has a body, a stem passing through the body, and a piston circumscribing the body;

wherein the body, the stem, and the piston are coaxial with an axis of the body;

wherein the stem is rotatable relative to the body, and the piston may move axially relative to the body;

an axial displacement sensor positioned between the piston and the body to detect relative axial motion between the piston and the body and generate an axial signal in response;

a transmitter communicatively coupled to the axial displacement sensor for transmitting the axial signal to a surface platform;

a receptor located at the surface platform and communicatively coupled to the transmitter for receiving the axial signal at the surface platform;

an operator interface device communicatively coupled to the receptor;

wherein the operator interface device is located proximate to an operator of the drilling rig, so that the receptor may transmit the axial signal to the operator interface device for further communication of the signal; and an encoder comprising:

a light source positioned to direct light in a radial direction;

a light sensor radially spaced from the light source and operable to detect a light from the light source; and a code cylinder positioned radially between the light source and the light sensor, the code cylinder defining a plurality of windows that are elongated in an axial direction, the windows permitting light from the light source to pass through the code cylinder.

11. The system of claim 10, wherein the axial displacement sensor comprises:

a tube positioned within the body, the tube having at least one solenoidal coil;

a ferromagnetic core positioned partially within the tube so that movement of the core through the tube produces an electrical output;

wherein an end of the core interacts with the piston to move in response to axial movement of the piston; and wherein axial movement of the piston relative to the body to energize a casing hanger seal releasably secured to the running tool will move the core through the tube, generating the axial signal conveying the amount of displacement of the piston relative to the body.

12. The system of claim 10, wherein the encoder is positioned between the stem and the body to detect relative rotation between the stem and the body and generate a rotation signal in response for communication through the transmitter and the receptor to the operator interface device.

13. The system of claim 12, wherein the light source is positioned on the stem so that the light source may direct the light radially outward; and wherein the code cylinder is positioned on an inner diameter surface of the body so that the code cylinder may be exposed to the light produced by the light source to generate the rotation signal.

14. The system of claim 13, wherein the light source is a photodiode placed on the inner diameter surface of the body; and the photodiode is alternatingly exposed to and blocked from the light source through the plurality of windows of the code cylinder during rotation of the stem relative to the body.

15. A method for running a subsea wellhead device, comprising:

(a) providing a running tool connected to the subsea wellhead device, the running tool having an encoder and axial displacement sensor coupled within the running tool for detecting running tool relative rotation and displacement, wherein the encoder comprises a code cylinder defining a plurality of windows that are elongated in an axial direction, the windows permitting light directed radially outward from a light source of the encoder to pass through the code cylinder and be detected by a light sensor of the encoder throughout an axial displacement of the light source with respect to the code cylinder;

(b) running the running tool from a surface platform to a subsea riser on a running string and positioning the subsea wellhead device in a subsea wellhead assembly;

(c) operating the running tool to set the subsea device in the subsea wellhead assembly;

(d) generating a signal in the encoder and the axial displacement sensor in response to setting of the subsea device;

(e) transmitting the signal from the encoder and the axial displacement sensor to a display at the drilling rig; then (f) presenting the signal in a manner understood by an operator.

16. The method of claim 15, wherein step (c) comprises rotating the running string to rotate a stem of the running tool relative to a body of the running tool to generate a signal in the encoder.

17. The method of claim 15, wherein step (c) comprises applying a hydraulic pressure down the riser string to move a piston of the running tool axially relative to a body of the running tool to generate a signal in the axial displacement sensor.

18. The method of claim 15, further comprising: connecting a receptor into the running string at a position above sea level; wherein step (e) comprises acoustically transmitting the signal to the receiving unit.

19. The method of claim 18, wherein acoustically transmitting the signal comprises transmitting the signal through a tubular of the running string.

* * * * *